United States Patent [19]

Glynn

[11] Patent Number: 4,964,553

[45] Date of Patent: Oct. 23, 1990

[54] UNIVERSAL LONG GUN SUPPORT AND HOLSTER

[76] Inventor: Donald J. Glynn, 48 Ramblewood Dr., North Chili, N.Y. 14514

[21] Appl. No.: 326,911

[22] Filed: Mar. 22, 1989

Related U.S. Application Data

[63] Continuation-in-part of Ser. No. 143,837, Jan. 19, 1988, abandoned.

[51] Int. Cl.[5] ..... F41C 33/00

[52] U.S. Cl. ..... 224/149; 224/208; 224/913

[58] Field of Search ..... 224/913, 149, 150, 151, 224/208, 214, 215, 216, 250

[56] References Cited

U.S. PATENT DOCUMENTS

| | | | |
|---|---|---|---|
| 2,526,768 | 10/1950 | Pendegrass | 224/913 X |
| 2,647,667 | 8/1953 | Brown et al. | 224/913 X |
| 2,778,552 | 1/1957 | Thompson | 224/913 X |
| 3,664,558 | 5/1972 | Tolliver | 224/913 X |
| 3,700,147 | 10/1972 | Vaughn | 224/149 |
| 3,869,074 | 3/1975 | Roach | 224/913 X |

*Primary Examiner*—Renee S. Luebke

*Attorney, Agent, or Firm*—Howard J. Greenwald

[57] ABSTRACT

A universal long gun support and holster system. This system contains (1) a waist belt, (2) a lateral gun support containing a forestock channel and a ductile anchor plate, (3) means for removably attaching the lateral gun support to the waist belt, (4) a shoulder strap, (5) means for removably attaching the shoulder strap to the waist belt and the lateral gun support, (6) means for forming a forestock web from a portion of the shoulder strap, (7) a butt support, (8) means for removably attaching the butt support web to the waist belt, the lateral gun support, and the shoulder strap, and (9) means for maintaining the forestock channel and the butt support web in a fixed spatial relationship.

14 Claims, 9 Drawing Sheets

UNIVERSAL LONG GUN SUPPORT AND HOLSTER

CROSS REFERENCE TO RELATED APPLICATION

This application is a continuation-in-part of applicant's copending application U.S. Ser. No. 143,837, filed Jan. 14, 1988, and now abandoned.

FIELD OF THE INVENTION

A combination gun support/holster device suitable for supporting the weight of a long gun during field carry.

DESCRIPTION OF THE PRIOR ART

Hunters often have to carry a gun for long distances before an occasion to use it arises. When they come across game, however, the gun should be quickly and quietly releasable from the gun support in which it is being carried; and the gun preferably should be in substantially ideal positon, ready for aiming.

There are many prior art gun supports or holsters which are particularly suitable for one application. To the best of applicant's knowledge, however, there is no gun support/holster system available in the prior art which is suitable for a multiplicity of applications and which, furthermore, can be readily configured by the hunter for different applications without substantial adjustment of the system. Furthermore, to the best of applicant's knowledge, no prior art support/holster system is readily and easily usable with all long guns, including those without shoulder butts.

It is an object of this invention to provide a gun support/holster device which can be readily and easily used in any one of several configurations, which can be readily used with all long guns, and which is readily and easily adjustable by a hunter during maneuvers in the field.

SUMMARY OF THE INVENTION

In accordance with this invention, there is provided a universal long gun support and holster system. This system contains (1) a waist belt, (2) a lateral gun support containing a forestock channel and a ductile anchor plate, (3) means for removably attaching the lateral gun support to the waist belt, (4) a shoulder strap, (5) means for removably attaching the shoulder strap to the waist belt and the lateral gun support, (6) means for forming a forestock web from a portion of the shoulder strap, (7) a butt support, (8) means for removably attaching the butt support web to the waist belt, the lateral gun support, and the shoulder strap, and (9) means for maintaining the forestock channel and the butt support web in a fixed spatial relationship.

DESCRIPTION OF THE DRAWINGS

The present invention will be more fully understood by reference to the following detailed description thereof, when read in conjunction with the attached drawings, wherein like reference numerals refer to like elements and wherein.

DESCRIPTION OF THE PREFERRED EMBODIMENTS

Figure 1:
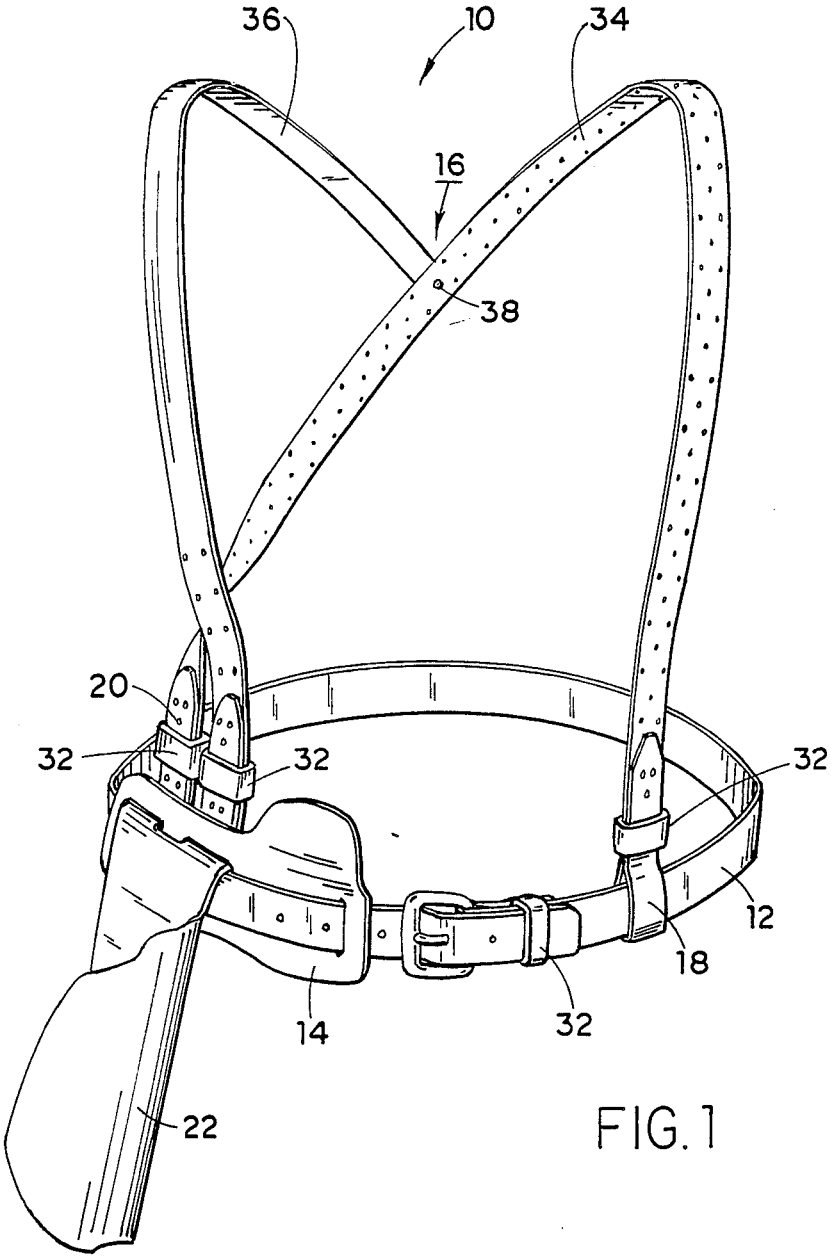
FIG. 1 is a perspective view of one preferred embodiment of the invention in which applicant's system is depicted without a gun.

FIG. 1 is a perspective view of one of the preferred embodiments of applicant's invention. Referring to FIG. 1, applicant's universal long gun support and holster system 10 is comprised of waist belt 12, a lateral gun support 14, a shoulder strap 16, means 18 for removably attaching shoulder strap 16 to waist belt 12, means 20 for removably attaching shoulder strap 16 to lateral gun support 14, and butt support web 22. As is evident from FIG. 1, the location of butt support web 22 may be varied, depending upon where the wearer desires to locate it with relation to waist belt 12.

Figure 2A:
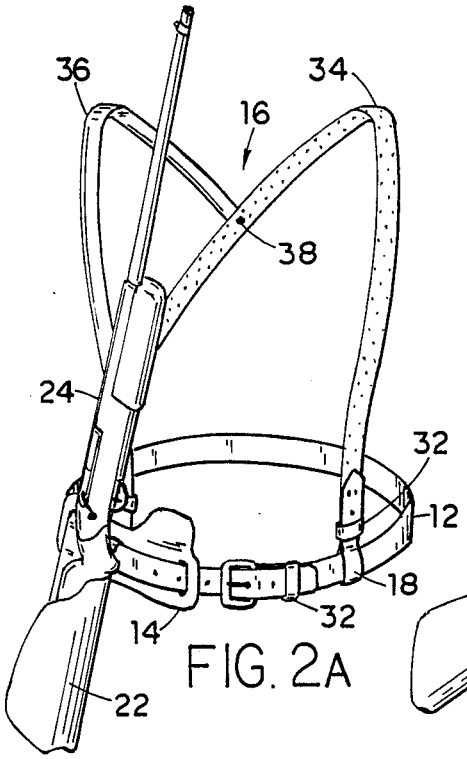
FIGS. 2A, 2B, and 2C are perspective views of one preferred embodiment of the invention showing the use of this embodiment with a long gun in various positions.
Figure 2B:
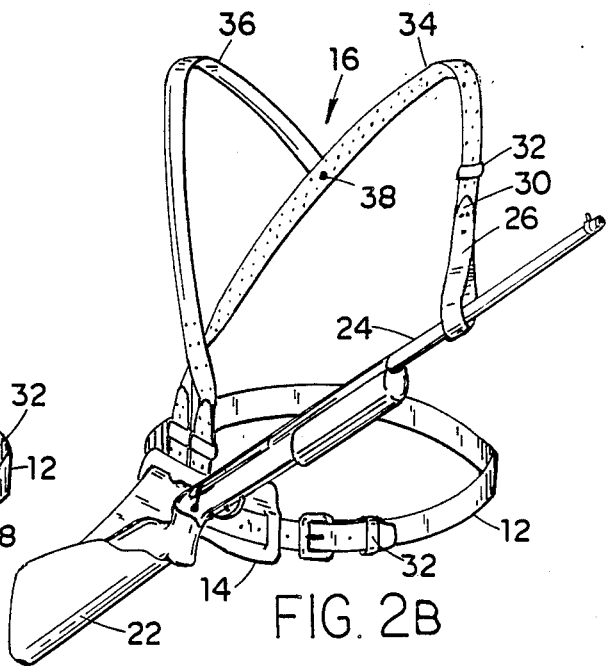
Figure 2C:
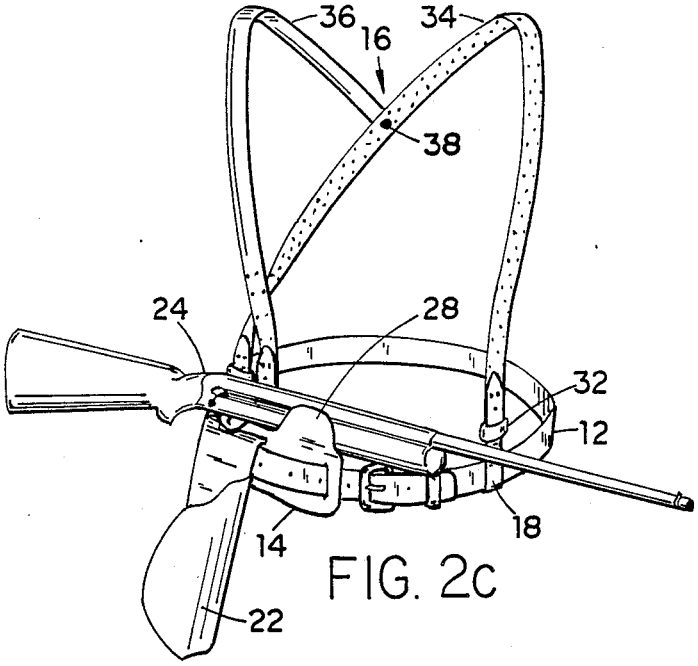

FIGS. 2A, 2B, and 2C illustrate the versatility of applicant's system. Because butt support web 22 is secured to waist belt 12 by tension accomodating flexible members (see FIG. 6), butt support web 22 is free to assume a variety of positions. One such position is illustrated in FIG. 2A, in which long gun 24 is in a substantially vertical position. Another such position is illustrated in FIG. 2B, in which long gun 24 is in a diagonal position and its barrel is secured by forestock web 26. Yet another position is illustrated in FIG. 2C, in which long gun 24 is disposed within the forestock channel 28 of lateral gun support 14. It should be noted that long guns without shoulder butts (not shown) can also be supported in forestock channel 28.

Forestock web 26 is formed from shoulder strap 16 by forming a loop from the end portion 30 of shoulder strap 16 and securing such end portion 30 to shoulder strap 16. End 30 may be secured to shoulder strap 16 to form forestock web 26 by any means well known to those skilled in the art. Thus, e.g., one may use belt keeper 32 in combination with a hook to secure these components. Thus, e.g., one may use the means disclosed in FIGS. 15 and 16.

In the embodiment illustrated in FIG. 2B, forestock web 26 and shoulder strap 16 are formed from two pieces of material, (pieces 34 and 36) which are joined together at point 38, the web 26 being formed by folding back end 30 of strap 16 and securing end 30 to strap 16. Shoulder strap 16 may contain a multiplicity of orifices so that junction point 38 may be located at a multiplicity of positions, thereby increasing the adjustability of the system. In another embodiment, not shown, forestock web 26 and shoulder strap 16 may be formed from one or three or more pieces of material. What each of the embodiments of this web 26/strap 16 combination have in common is that they are adjustable. Strap 16 can be adjusted.

Figure 3:
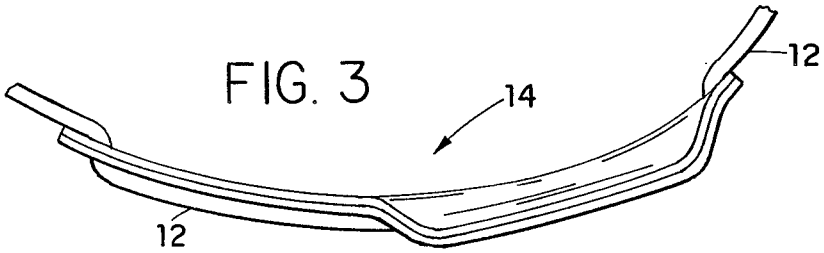
FIG. 3 is a top view of the lateral gun support component of applicant's system.

Referring to FIG. 3, a top view of lateral gun support 14 is shown. In FIG. 3, waist belt 12 is shown extending through two substantially vertical slots (not shown) in lateral gun support 14. A ductile plate (not shown) in lateral gun support 14 allows the wearer to shape lateral gun support 14 to the configuration of his hip.

Figure 4:
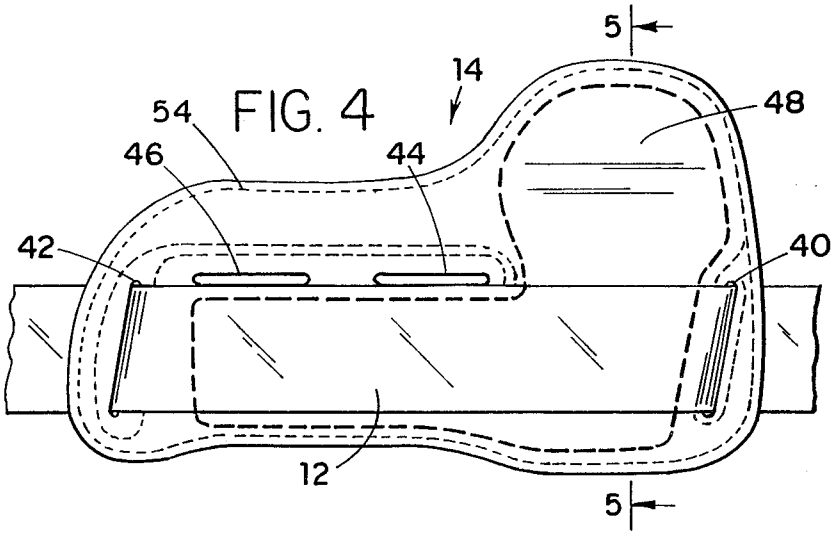
FIG. 4 is a front view of the lateral gun support component.

Referring to FIG. 4, a front view of lateral gun support 14 is shown. As can be seen from this view, lateral gun support 14 is comprised of at least two substantially vertical slots 40 and 42 through which waist belt 12 is inserted, thereby providing means for removably attaching lateral gun support 14 to waist belt 12.

As can be seen from FIG. 4, lateral gun support 14 also is comprised of at least two substantially horizontal slots 44 and 46. These horizontal slots may be used to provide a portion of the means for removably attaching shoulder strap 16 to lateral gun support 14; see, e.g., FIG. 10. These horizontal slots may also be used to provide a portion of the means for removably attaching butt support web 22 to lateral gun support 14; see FIG. 10.

Referring again to FIG. 4, lateral gun support 14 is also comprised of a ductile anchor plate whose function is to maintain its molded position on the body of the wearer, and to help form forestock channel 26. In the embodiment illustrated in FIG. 4, ductile anchor plate 48, is within an envelope which it reinforces. This embodiment may be produced by inserting metallic, ductile anchor plate 48 within an envelope formed by a front piece and back piece 52 which may be stitched to enclose plate 48 as indicated by dotted line 54.

The ductile anchor plate is very important in applicant's system, for it forms forestock channel 26 in which long gun 24 may be placed. Thus, referring to FIG. 5, ductile anchor plate 48 and the envelope in which it is contained (comprised of sides 50 and 52) form a structure which, at its top end, is curved and is adapted to receive the forestock of long gun 24. Although the device is shown as being curved in its upper end to adapt to the shape of gun 24, it should also be realized that the device may be curved to adapt to the shape of the wearer's body. Because of the ductility of this structure, the degree of curvature of the device may be varied to accommodate various gun configurations and various body dimensions.

Figure 5:
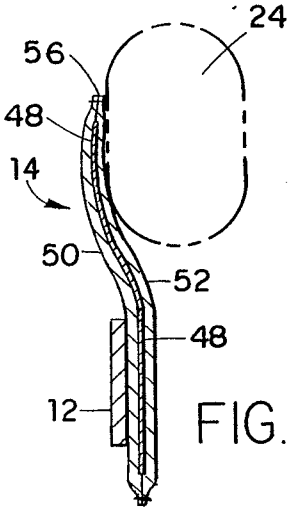
FIG. 5 is a side view of the lateral gun support component.

FIGS. 4 and 5 have shown one preferred embodiment of the ductile anchor plate of which the lateral gun support 14 is comprised. As will be apparent to those skilled in the art, other embodiments of such plate may be used. Thus, for example, any ductile material may be used for plate 48; metal, plastic-coated metal, plastic, and other ductile materials may be used. Thus, for example, an envelope may be formed not by stitching but by coating ductile metal with plastic. Thus, for example, there need not be an envelope enclosing the ductile material.

Figure 6:
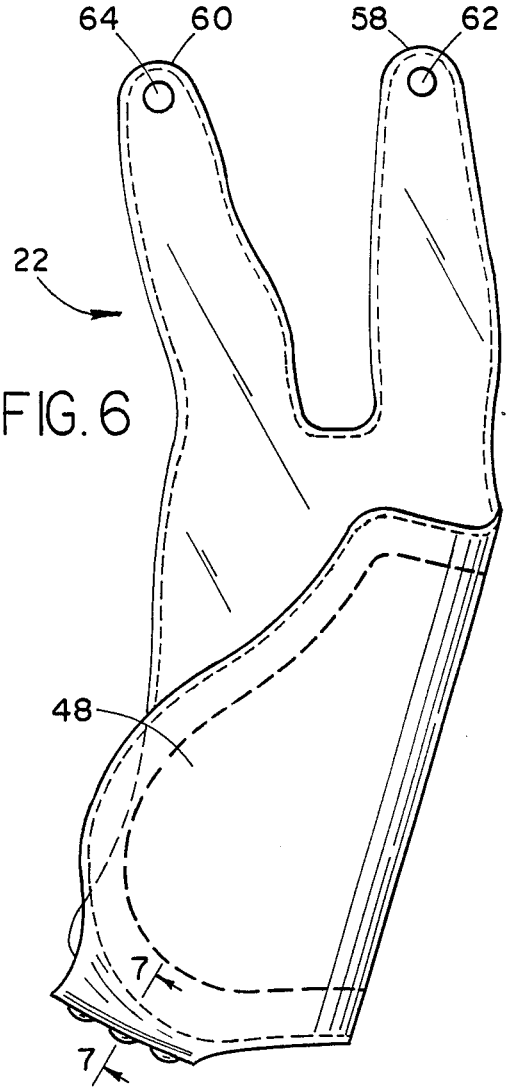
FIG. 6 is a front view of a preferred embodiment of the butt support web component of applicant's system.

Referring to FIG. 6, a preferred embodiment of butt support web 22 is shown. In this embodiment, butt support web 22 is comprised of finger-like extensions 58 and 60 which, after having been bent and inserted through horizontal slots 44 and 46 and bent backwards, may be secured to a yoke (see FIGS. 10, 11, and 12). Orifices 62 and 64 in fingers 58 and 60 may be used to secure fingers 58 and 60 to the yoke. Alternatively, other well known fastening means may be used.

Figure 7:
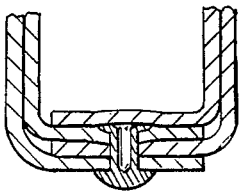
FIG. 7 is a sectional view of the web of FIG. 6, taken along lines 7—7.

It is preferred that butt support web 22 be comprised of a trough at the bottom of the web which partially closes the web. FIG. 7 illustrates such a trough in the embodiment of FIG. 6; in this embodiment, the trough is inclined at an angle of from about 15 to about 45 degrees.

Figure 8:
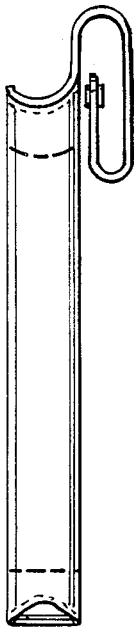
FIG. 8 is a side view of the butt support web of FIG. 6.

FIG. 8 is a side view of the butt support web of FIG. 6.

Figure 9:
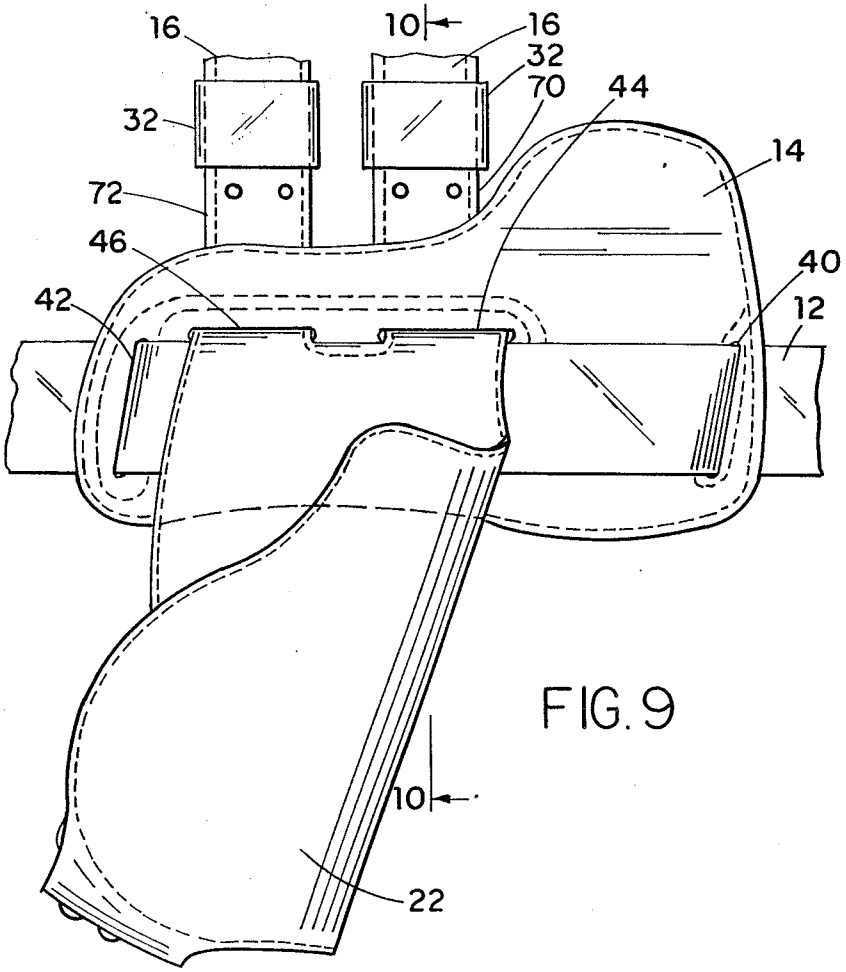
FIG. 9 is a partial perspective view of the system of FIG. 1, showing the connection of the lateral gun support, the butt support web, and the shoulder strap components of the system.

FIG. 9 is a partial view illustrating how butt support 22, shoulder strap 16, and waist belt 12 are connected to each other. Fingers 58 and 60 (not shown) are passed through horizontal slots 44 and 46; see, e.g., FIG. 10. After the fingers are passed through such slots, they are then bent and secured to yoke 66 by fastener 68 (see FIG. 10).

Figure 10:
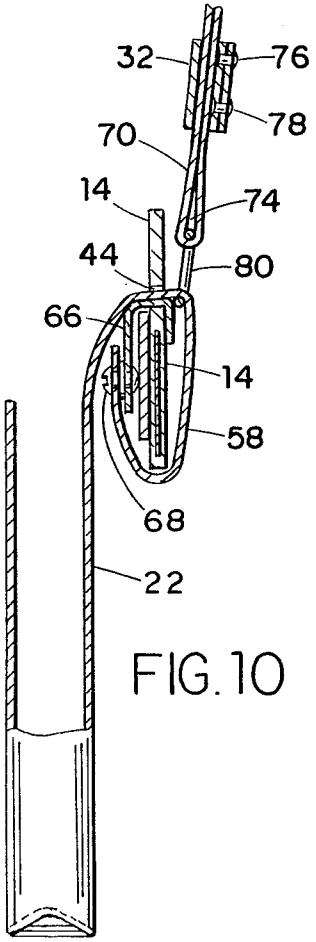
FIG. 10 is a side view of the system of FIG. 1, showing the connection of the lateral gun support, the butt support web, and the shoulder strap components of the system.

The ends 70 and 72 of shoulder strap 16 may be passed through horizontal slots 44 and 46. Alternatively, they may be looped and attached to the shoulder strap to form a web, and the web may then be attached to one or more of fingers 58 and 60. Thus, referring to FIG. 10, end 70 is folded back onto itself to form loop 74; end 70 is secured to shoulder strap 16 by belt keeper 32, which in the embodiment shown in FIG. 10 is comprised of fasteners 76 and 78. Loop 74 is then removably attached to the loop formed by finger 58 by harness ring 80.

Waist belt 12 is passed through substantially vertical slots 40 and 42.

As those skilled in the art will realize, other securing means besides those shown in FIGS. 9 and 10 may be used. Thus, by way of illustration and not limitation, one may use securing means such as a screw and post combination, an eyelet, a rivet/tubular spacer combination, and like. Other suitable securing means are described in a book by C. Jensen and J. D. Helsel entitled "Engineering Drawing and Design," (Gregg Division, McGraw-Hill Book Company, New York, 1985), the disclosure of which is hereby incorporated by reference into this specification; pages 164–226 of this book are of special interest regarding fasteners. Other suitable locking means are disclosed in U.S. Pat. No. 4,249,686 of Morwood, the disclosure of which is also incorporated by reference into this case.

The use of belt keepers, such as belt keeper 32, is well known to those in the art. Any of the belt keepers known to the art may be used. Thus, e.g., the belt keepers offered for sale by the Bianchi Catalog 1986 (published by Bianchi International, 100 Calle Cortez, Temecula, Calif. 92390) may be used. In one embodiment, it is preferred that belt keeper 32 be a free belt keeper, i.e., that it be free to move over shoulder strap 16.

Figure 11:
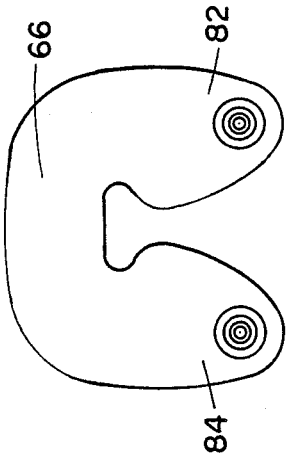

FIG. 11 illustrates one embodiment of yoke 66. With this embodiment, finger 82 may be inserted through horizontal slot 44, and finger 84 may be inserted through horizontal slot 46; these fingers are inserted through the back of lateral gun support 14. As is shown in FIG. 10, such fingers extend from the back of the lateral gun support 14, down over the front of lateral gun support 14, where they are attached to the fingers 58 and 60 of butt support web 22; the latter fingers are inserted through horizontal slots 44 and 46, wrapped around the back of lateral gun support 14, and brought up to the front of said lateral gun support 14 where they are attached to the fingers of the yoke by conventional attachment means.

Figure 12:
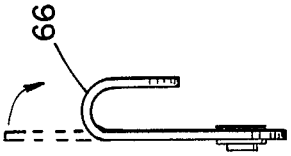
FIG. 11 and 12 illustrate a yoke which may be used in applicant's system.

FIG. 12 is a side view of yoke 66, showing it folded into position on the lateral gun support (not shown).

Figure 14:
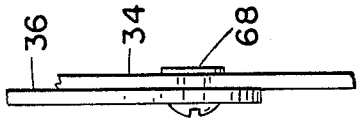
FIGS. 13, 14, 15, and 16 illustrate means for fastening the shoulder strap component of applicant's system.
Figure 13:
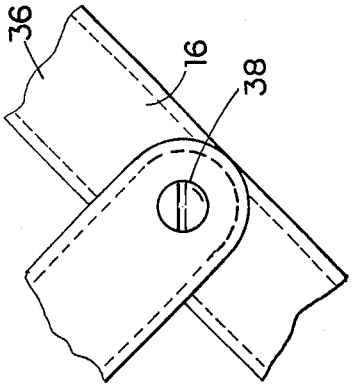

FIG. 13 illustrates the joining of pieces 34 and 36 of shoulder strap 16 at point 38. In FIG. 14, conventional fastener 68 is shown securing these pieces together.

Figure 15:
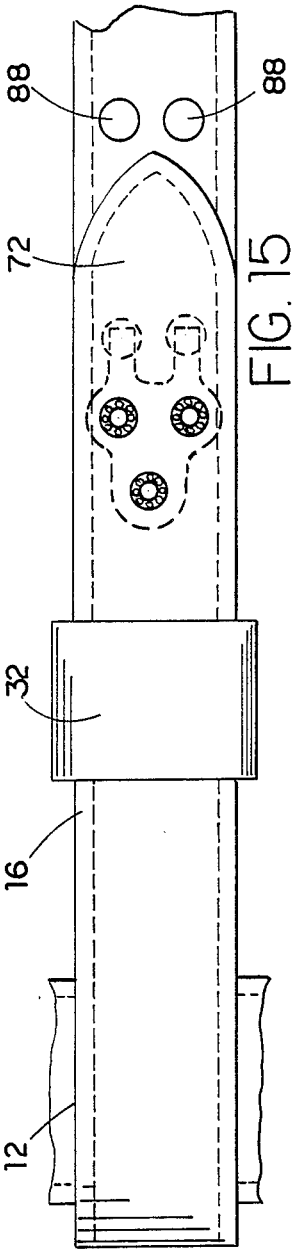

FIG. 15 is a front view of a portion of shoulder strap 16, showing how end 72 of the strap may be removably attached to the rest of the strap. Belt keeper 32 helps to secure end 72 to the remainder of strap 16. Additionally, the teeth (not shown) in claw 86 may be inserted into holes 88 to fasten end 72 to strap 16. Alternatively, other holes in the strap may be used to make such connection, thereby giving one adjustability.

Figure 16:
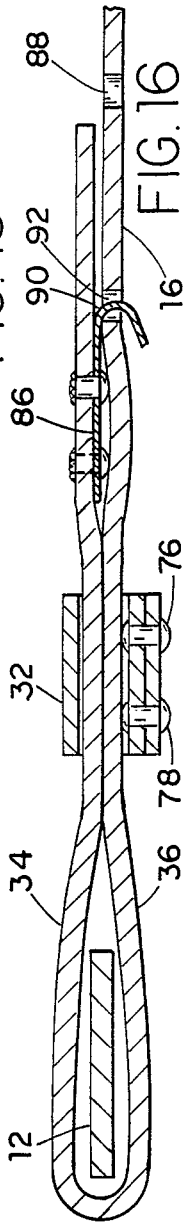

FIG. 16 is a side view of the embodiment of FIG. 15, showing how the attachment may be made. In the embodiment illustrated in FIG. 16, tooth 90 is inserted through hole 92 in strap 16 to make the attachment. Although not shown, it is to be understood that on the other side of the strap there is another tooth 90 going through another hole 92.

Figure 17:
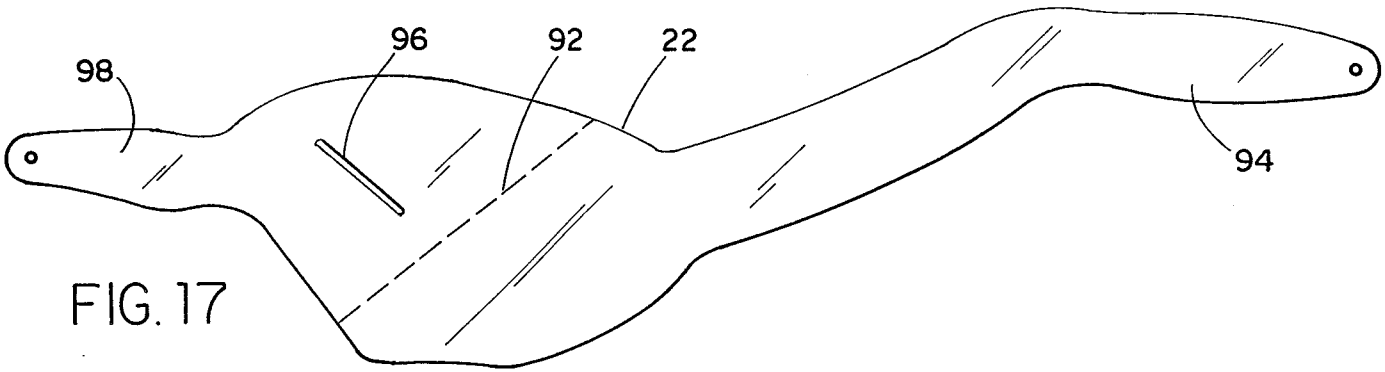
FIGS. 17 and 18 are views of a preferred embodiment of an integral butt support web component for applicant's system.
Figure 18:
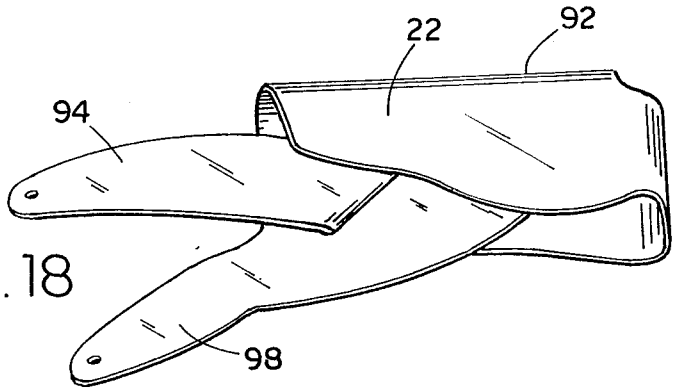

FIGS. 17 and 18 illustrate a preferred embodiment of butt support web 22. In this embodiment, web 22 is seamless. The embodiment illustrated in FIG. 17 may be folded to produce either a right-handed or left-handed version of the butt support web 22. Thus, this embodiment may be folded at line 92, and may be brought around and through slot 96 to form the structure of FIG. 18. Fingers 94 and 98 may be fastened to waist belt 12 and/or shoulder strap 16 by means heretofor described.

Figure 19:
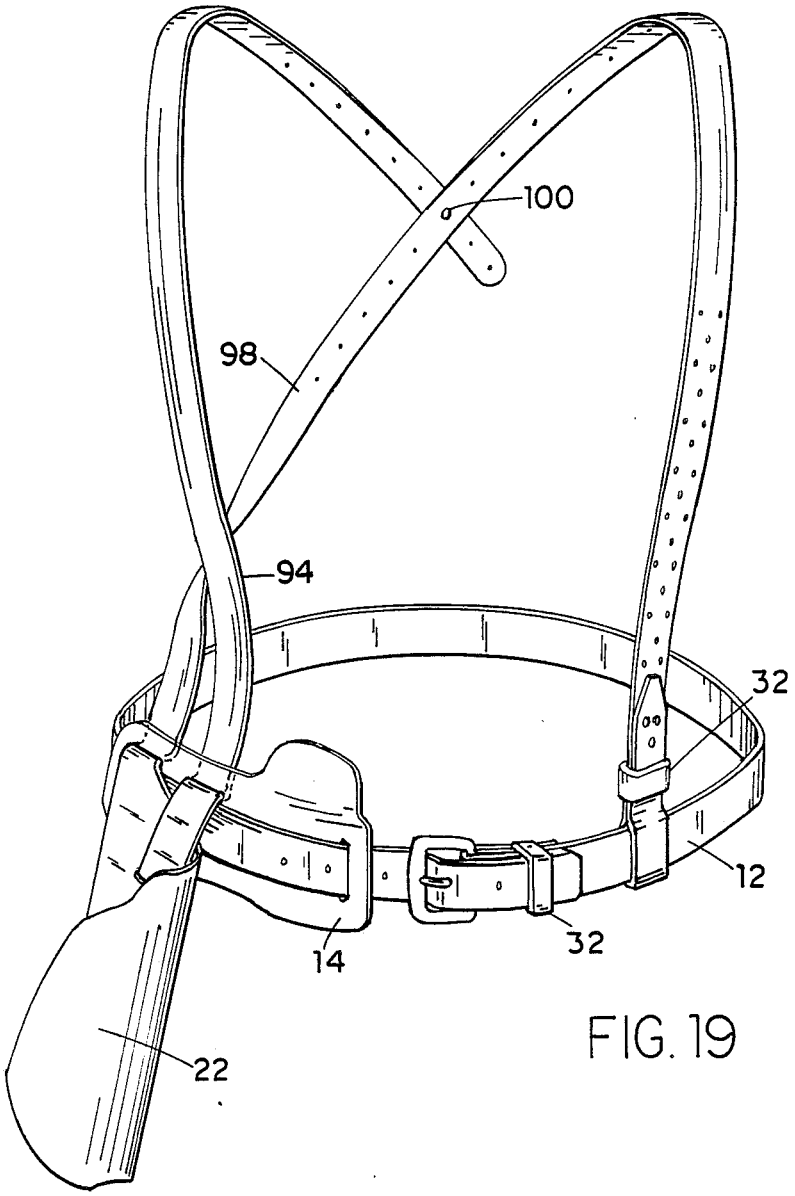
FIGS. 19 and 20 illustrate preferred embodiments of applicant's system utilizing the integral butt support web of FIGS. 17 and 18.

FIG. 19 illustrates another embodiment of this invention in which the butt support web of FIGS. 17 and 18 is used to provide a new apparatus. In this embodiment, fingers 94 and 98 are extended in length so that they serve as both fingers and shoulder strap and forestock web; these finger/shoulder strap components are joined to each other at point 100, and finger 98 can then be removably attached to waist belt 12 by means of belt keeper 32. Because of the presence of a multiplicity of orifices in fingers 94 and 98, point 100 may be located at many different sites. Furthermore, adjustability is also furnished by varying the length of fingers 94 and 98 and the manner in which finger 98 is attached to waist belt 12.

Figure 20:
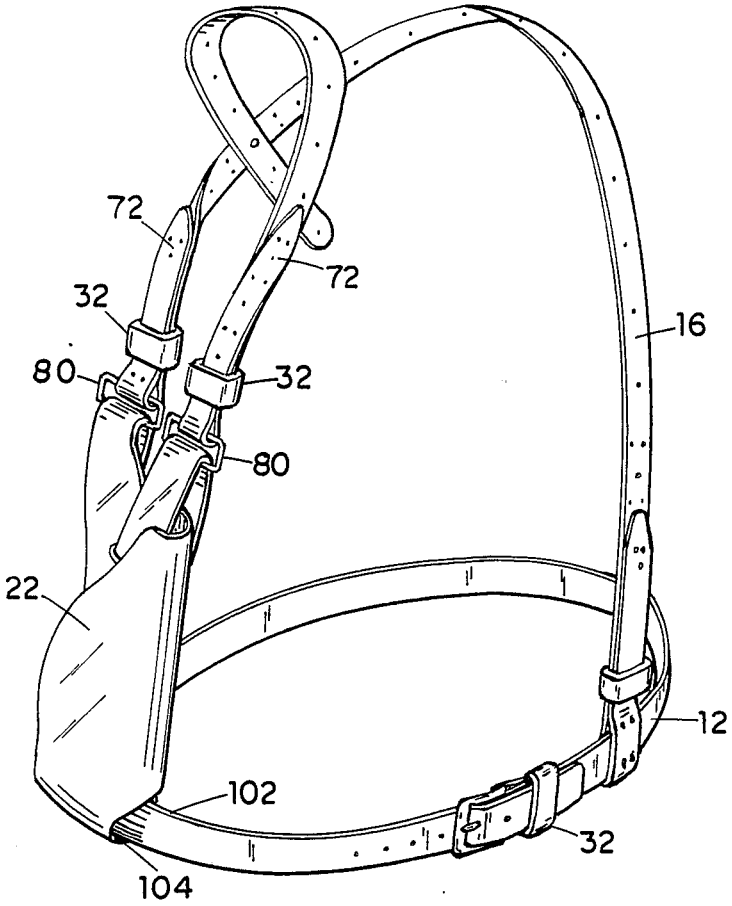

FIG. 20 illustrates another embodiment of this invention in which butt support web 22 is made from the embodiments of FIGS. 17 and 18 and, after being so made, is retained by waist belt 12. Portion 102 of waist belt 12 passes through an opening in butt support web 22. Shoulder strap 16 is then attached to waist belt 12 by means heretofore described.

It is to be understood that the aforementioned description is illustrative only and that changes can be made in the apparatus, the ingredients and their proportions, and in the sequence of combinations and process steps as well as in other aspects of the invention discussed herein without departing from the scope of the invention as defined in the following claims.

I claim:

1. A universal long gun support and holster system, comprising:

(a) a waist belt;

(b) a lateral gun support removably attached to said waist belt, comprised of a forestock channel, at least two substantially vertical slots, at least two substantially horizontal slots disposed above said vertical slots, and a ductile anchor plate, wherein said waist belt is disposed within each of said substantially vertical slots in said lateral gun support;

(c) a shoulder strap assembly comprised of a first strap and a second strap, wherein said first strap and said second strap are attached to each other; and (d) a butt support web removably attached to said lateral gun support, to said first strap, and to said second strap, wherein said butt support web is comprised of at least two finger-like extensions, and wherein each of said finger-like extensions is disposed within one of said substantially horizontal slots in said lateral gun support.

2. The system as recited in claim 1, wherein said shoulder strap assembly is comprised of a multiplicity of orifices.

3. The system as recited in claim 1, wherein said butt support web is comprised of a trough at the bottom of the web which partially closes the web.

4. The system as recited in claim 1, wherein said ductile anchor plate consists essentially of a material selected from the group consisting of metal, plastic coated metal, and plastic.

5. The system as recited in claim 4, wherein said ductile anchor plate consists essentially of metal.

6. The system as recited in claim 4, wherein said ductile anchor plate consists essentially of plastic-coated metal.

7. The system as recited in claim 1, wherein said butt support web is secured to said waist belt by tension accommodating flexible members.

8. The system as recited in claim 7, wherein said shoulder strap assembly is comprised of a belt keeper.

9. The system as recited in claim 8, wherein said shoulder strap assembly is comprised of a multiplicity of orifices.

10. The system as recited in claim 9, wherein said ductile anchor plate consists essentially of a material selected from the group consisting of metal, plastic-coated metal, and plastic.

11. The system as recited in claim 10, wherein said ductile anchor plate consists essentially of plastic.

12. The system as recited in claim 10, wherein said ductile anchor plate consists essentially of plastic-coated metal.

13. The system as recited in claim 10, wherein said ductile anchor plate consists essentially of metal.

14. The system as recited in claim 13, wherein said butt support web is comprised of a trough at the bottom of the web which partially closes the web.

* * * * *